United States Patent [19]

Döring et al.

[11] 3,948,019

[45] Apr. 6, 1976

[54] APPARATUS FOR THE FULLY AUTOMATIC PRODUCTION OF FILLED, GUSSETED BAGS OF PLASTIC

[75] Inventors: Werner Döring; Paul Raderschad, both of Hennef-Sieg, Germany

[73] Assignee: Siegrheinische Registrierwaagenfabrik "FIX" Peter Steimel KG, Hennef-Sieg, Germany

[22] Filed: Jan. 11, 1974

[21] Appl. No.: 432,794

[30] Foreign Application Priority Data

Jan. 15, 1973 Germany ..... 2301817

[52] U.S. Cl. ..... 53/63; 53/183; 53/187; 53/202; 53/253; 53/373; 53/385; 53/386

[51] Int. Cl.[2]. B65B 57/06; B65B 43/02; B65B 1/02

[58] Field of Search ..... 53/29, 183, 187, 188, 190, 53/202, 253, 385, 386, 63, 261, 266, 373

[56] References Cited

UNITED STATES PATENTS

| | | | |
|---|---|---|---|
| 2,781,620 | 2/1957 | Hopkins et al. | 53/188 X |
| 3,112,588 | 12/1963 | Barraclough | 53/187 |
| 3,112,777 | 12/1963 | Lohse | 53/187 X |
| 3,201,914 | 8/1965 | Lohse et al. | 53/187 |
| 3,492,775 | 2/1970 | Rhine et al. | 53/29 |
| 3,728,840 | 4/1973 | Izumi | 53/29 |
| 3,812,644 | 5/1974 | Kamikawa et al. | 53/29 |

*Primary Examiner*—Robert L. Spruill
*Attorney, Agent, or Firm*—Burgess, Dinklage & Sprung

[57] ABSTRACT

Automatic Production, filling, and closing of bags, especially plastic gusseted bags. The bag is produced at a first station of the apparatus for carrying out the invention, from a flat tube. The bag is then successively moved to a second station where it is filled, a third station where it is sealed or closed, and a fourth station at which it is transferred from the machine to a delevery point which may be outfitted with a conveyor for transferring the filled and closed bag to a storage area.

18 Claims, 15 Drawing Figures

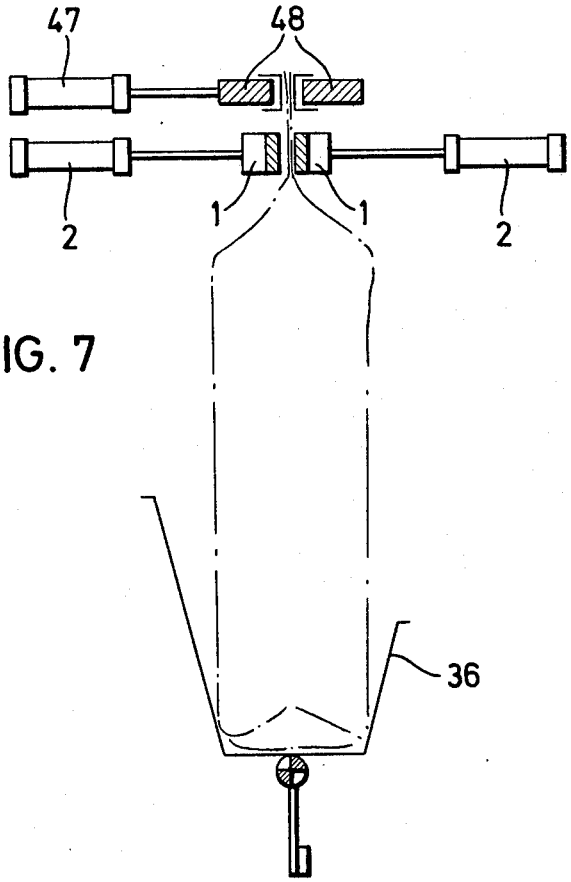
FIG. 7
FIG. 8
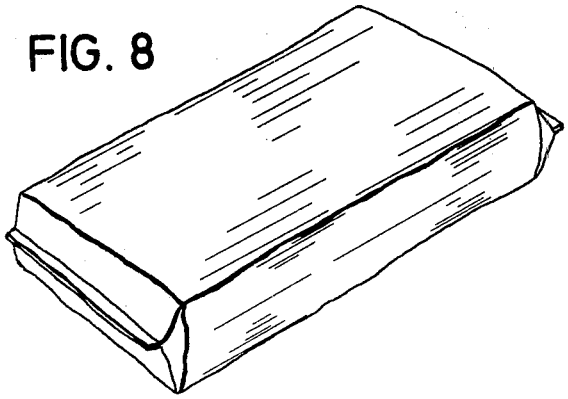

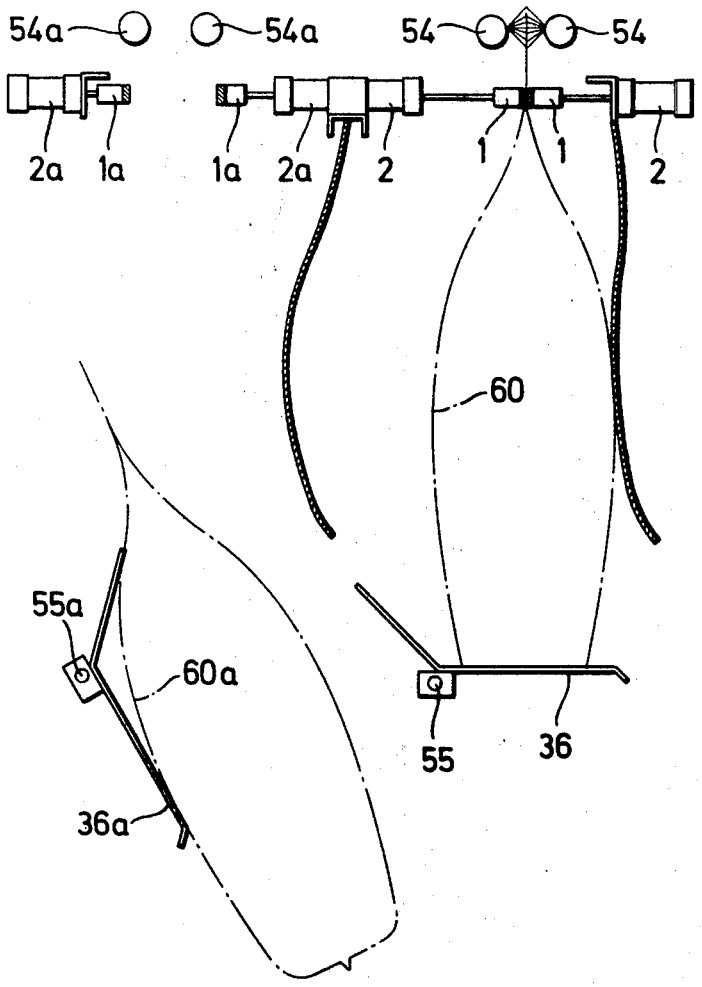
FIG. 12
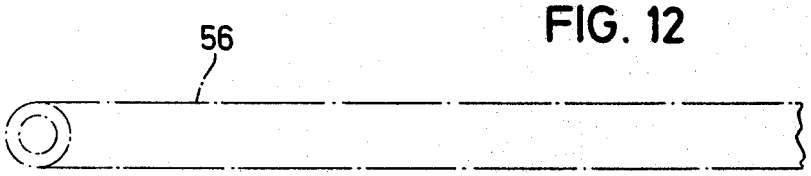

APPARATUS FOR THE FULLY AUTOMATIC PRODUCTION OF FILLED, GUSSETED BAGS OF PLASTIC

In the packaging art, apparatus are known which take bags made from a roll of lay-flat film or which take bags from a stack of bags and automatically transfer them to a bag opening nozzle which grips the bags. These apparatus are used preferably with flat bags or with sacks having a short or long wall.

Apparatus are also known in which an open-top gusseted bag is open by hand, placed over a filler spout and gripped with a bag spreading nozzle or with a bag clamp. When the bags are filled the gussets are forced outwardly and usually stitched or welded. Only by means of succeeding refolding devices is it possible to close the bag with the gussets folded inwardly.

The known apparatus have the disadvantage that they are not fully automatic and require expensive refolding devices in order to reshape the gussets after filling.

Furthermore, it is not in the prior art to produce automatically filled gusseted bags.

The invention is addressed to the problem of setting out from a rolled tubular film provided with gussets and producing, filling and closing, in a fully automatic manner, gusseted bags of plastic or paper or a lamination of plastic and paper.

The subject matter of the invention is therefore a method for the fully automatic production of filled gusseted bags, in which a gusseted tube of plastic or paper or a lamination of plastic and paper is provided with a bottom seam, cut off the length of bag desired, the bag is opened at the top while retaining the gussets, it is filled with a prescribed amount of material, the open sidewalls in the unfilled upper portion are drawn together, and the bag is here provided with a top seam.

Gusseted bags of paper or plastic or combinations of both materials are known. Gusseted tubes of thermoplastics such as polyvinyl chloride, polyolefins, polyesters, polyamides and the like are also available commercially. For the purpose involved herein, they especially have wall thicknesses of 100 to 2500 $\mu$m. A certain portion of the circumference of the bag is folded inwardly at opposite sides. Such gusseted tubes of plastic may be wound in the collapsed state into rolls of great length. These are the preferred starting material for the method of the invention. Since it is filled, box-shaped, gusseted bags that are to be prepared by the method of the invention, containing for example, 10 to 100 kg. of solid or liquid, the choice of the dimensions of the bag and of the wall thickness is largely left to the technical expert who knows which wall thickness must be selected for the particular material and what the ratio of the circumference of the bag must be to its height so that the filled bags will be as box-shaped and easy to stack as possible.

The process of the invention may be divided into four operations or stations, namely the making, the filling and the closing of the bag and the transfer of the filled bag to a succeeding transport means. These operations are carried out on a straight line or preferably on a circular path, open-topped gusseted bags being transported from station to station by means of transport grippers after they have been made, and after they have been filled, if not before, they are transported by means of bag seats located underneath them.

If the gusseted tube is supplied in the collapsed and rolled-up state, first so much of this material is pulled out by means of transport rolls that a transverse seam may be provided in it, which later becomes the bottom seam of the gusseted bag. This seam may be produced by stitching, cementing or welding depending on the material selected. If, as it is preferred, the gusseted tube consists of a thermoplastic, the bottom seam, and later on the top seam, too, is made by welding. In continuous opereation, the transport rolls each time pull out a certain adjustable length, which is determined by counting pulses or even photoelectrically if the film is imprinted. Then the drawn-out length of the gusseted tube is gripped by transport grippers, welded transversely a few centimeters beyond, and then severed below the welded seam. The transport grippers hold the collapsed, open-topped but bottom-seamed, gusseted bag which projects above the transport grippers by a few centimeters, e.g., 3 to 10 cm. This projecting portion is important to enable the bag to be held here by other gripping jaws during the succeeding operations, or to be gripped here by devices to open it. As a rule, the plastic material used for the manufacture of large gusseted bags of this kind has sufficient stiffness to enable the portion of the bag projecting beyond the transport grippers to stand erect. If the material is too thin, so that it might droop over, it may be held up with known means such as clips or springs. The bag thus held is then transported to the filling station. There the gusseted bag is transferred to other gripping jaws which hold it only at the gussets, and oppositely located suction nozzles attach themselves to the bag walls between the gussets. The closed gripping jaws are shifted toward the center while the suction nozzles are moved positively away from the center so that the bag opens in the manner of a parallelogram. A filling nozzle is plunged into the opened bag. A control device checks to assure that a bag is present and that it is open. If both conditions are fulfilled, the bag is lifted and filling with the weighted or measured material begins. With the lifting of the bag or the lowering of the bag seat, as the case may be, maximum fill is achieved. Since the distance between the transport grippers and the bottom of the bag seat is governed by the height of the filled bag, the empty bag lies curled in the bag seat. So if it were not lifted up during the filling operation, none of the material being poured would be able to enter the curled bottom portion of the bag and the bag would not be adequately filled. As soon as the material has filled out the bottom portion of the bag, the bag is lowered again, so that the partially filled bag will stand with its bottom on the bag seat; then the filling is completed. It is not necessary to interrupt the filling process: the lowering of the bag may begin as soon as the bottom of the bag is filled with material. When the filling is completed the filling nozzle is removed from the bag; the bag is drawn taut as the gripping jaws holding it at the gussets return to their starting position. Then the transport grippers take over the filled bag and transport it entirely automatically to the third station where the filled bag is closed with a top seam, preferably above the transport grippers, the seam being made most simply by welding in the case of thermoplastics. Apparatus for this purpose are known. In the making of the seams in gusseted bags, since four thicknesses of the bag materials have to be welded in the area of the gussets and only two thicknesses have to be welded between them, so-called pulse seams made by high-frequency welding are to be preferred to melted seams.

The filled bag, closed at the top, is then transported to the last station. Here it remains standing for a time to enable the welded seam to cool. Then the transport grippers are opened, the bag seat is rocked over, and the filled bag is transferred to a succeeding conveyor means.

The various steps of the process of the invention have been divided among four stations in the case described above. The technical expert may optionally group them differently, e.g., dividing them among more stations or combining them. As it is easily apparent, it is not outside of the scope of the invention to set out from already manufactured bags which are already provided with a bottom seam and are stacked up, for example, for then the bag making station will be replaced by a known device for picking up the bags and transferring them to the filling station. In like manner, the way in which the sealed bags are offborne depends on the circumstances of the operation. In dividing the process into four stations it has been found to be especially expedient to arrange them in uniform distribution about a circle, while a turnstile having four bag seats and transport grippers corresponding thereto advances the bags at a uniform rate from station to station. The time elapsing between each 90° turn of the turnstile will depend on the station whose operations take the longest. It is, however, easily possible to get by with a standing time at each station of 10 seconds and less. It is thus possible by means of the invention to produce, fill, close and carry away several hundred gusseted bags per hour in a fully automatic manner. The output may be further increased under certain circumstances by increasing the number of circularly arranged stations and shortening the longest time of stay at one station.

The output of the apparatus of the invention may be still further increased, i.e., even more filled and closed bags may be obtained per unit of time, without having to shorten the cycle time or standing time at the individual stations. This increase in output is achieved by advancing not just one bag but two or more bags simultaneously, at a uniform rate, from the bag making station to the bag transfer station, i.e., two or more bags are processed simultaneously in each station, being preferably arranged with their flat sides adjacent one another. In this manner the output may be doubled, tripled, etc.

Two preferred embodiments of the invention are represented diagrammatically in the drawing by way of example.

FIG. 7 is a diagrammatic representation of the closing station (Station III);

FIG. 8 shows a filled, box-shaped gusseted bag;

FIG. 12 shows the bag transfer station IV of the second embodiment.

Figure 1:
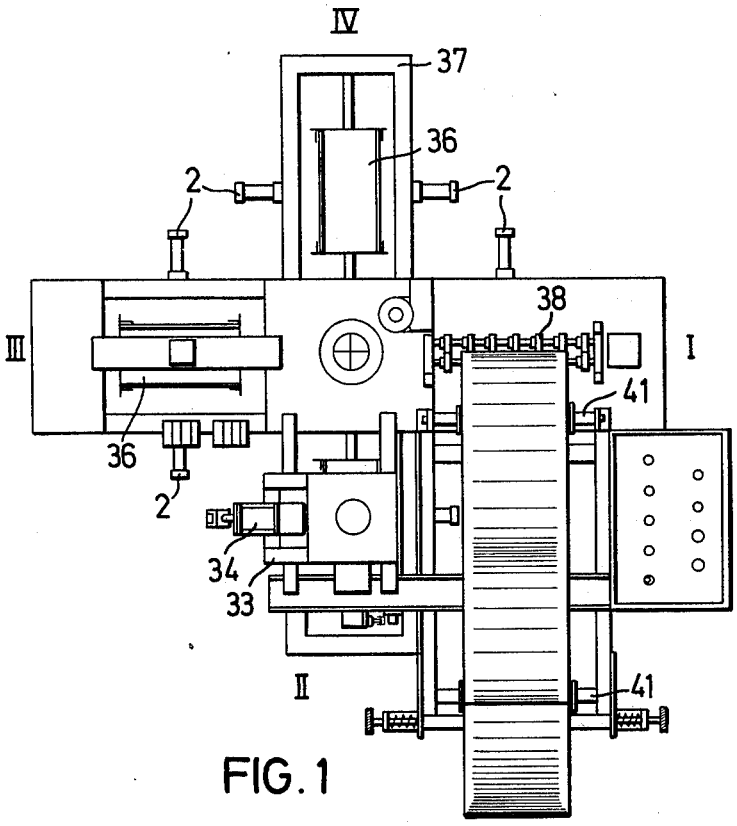
FIG. 1 is a top plan view of the entire apparatus.
Figure 2:
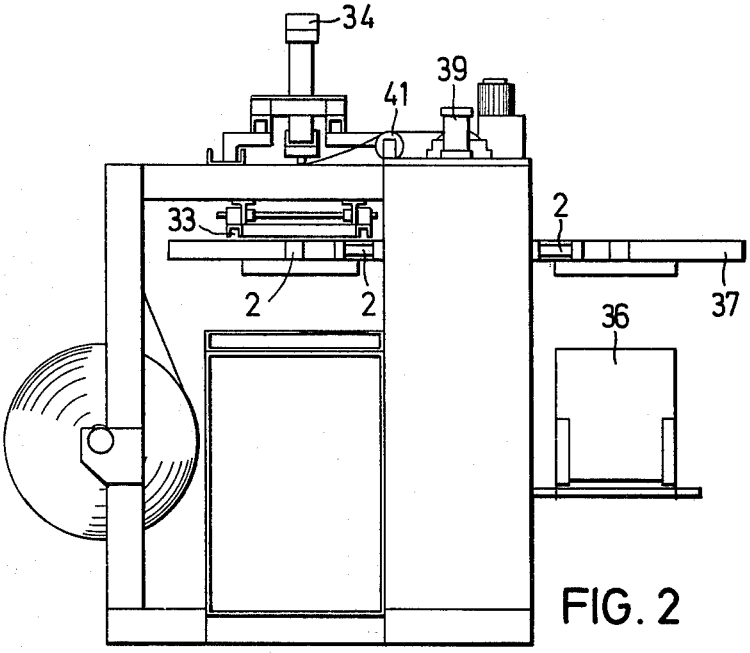
FIG. 2 is a side elevation of the entire apparatus.
Figure 3:
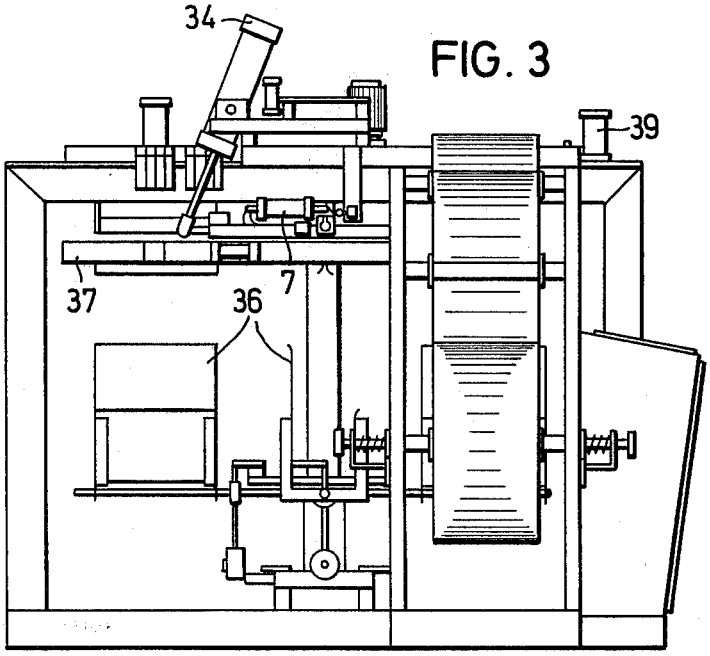
FIG. 3 is another side elevational view of the entire apparatus.

In accordance with FIGS. 1 to 3, the entire apparatus consists of four working stations I to IV which are arranged in a stationary manner, uniformly distributed about the circumference of a circle. Underneath these four stations there is rotatably disposed a four-armed turnstile 37 having four bag seats 36 and four transport clamps or transport grippers 1 which, in the embodiment of FIGS. 1 to 8, advance a single bag successively, at uniform time intervals, from Station I to Station IV.

A detailed description will now be given of the four working stations I to IV of the first embodiment represented in FIGS. 1 to 8.

Bag Making Station I

Figure 4:
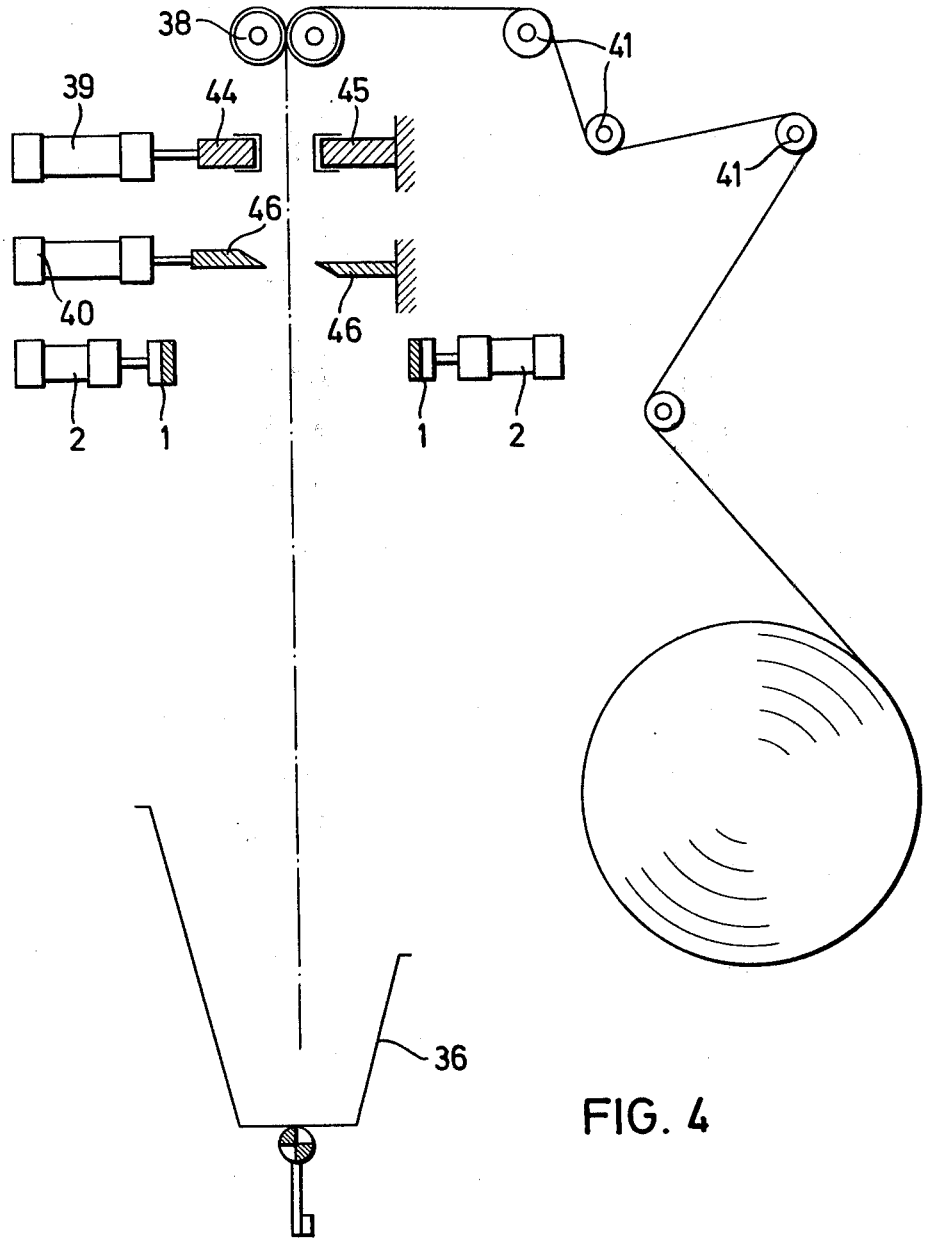
FIG. 4 is a diagrammatic representation of the bag making operation (Station I)

As seen in FIGS. 1 to 4, a gusseted tube 42 is drawn by means of feed rolls 38 over idler rolls 41 from a supply roll. The bag length or the number of turns of feed rolls 38 that are required is controlled by counting pulses or, in the case of a ready-printed gusseted tube, photoelectrically. After the transport of the tube, the two compressed air cylinders 2 advance the transport grippers 1 and grip the tube tightly. At the same time, the compressed air cylinder 39 advances the movable welding jaw 44 against the stationary welding jaw 45 and the bag is welded (FIG. 4). It is, of course, also possible to provide two movable jaws for the welding. The cut-off knives 46, of which, in FIG. 4, one is stationary and the other is moved by means of the compressed air cylinder 40, sever the gusseted tube. In this manner a bag is made in continuous operation. After the cutting action the cutting and welding jaws open. The closed transport grippers 1, with the prepared, open-topped gusseted bag, are now transported by the turnstile 37 to the bag filling station II.

Bag Filling Station II

Figure 5:
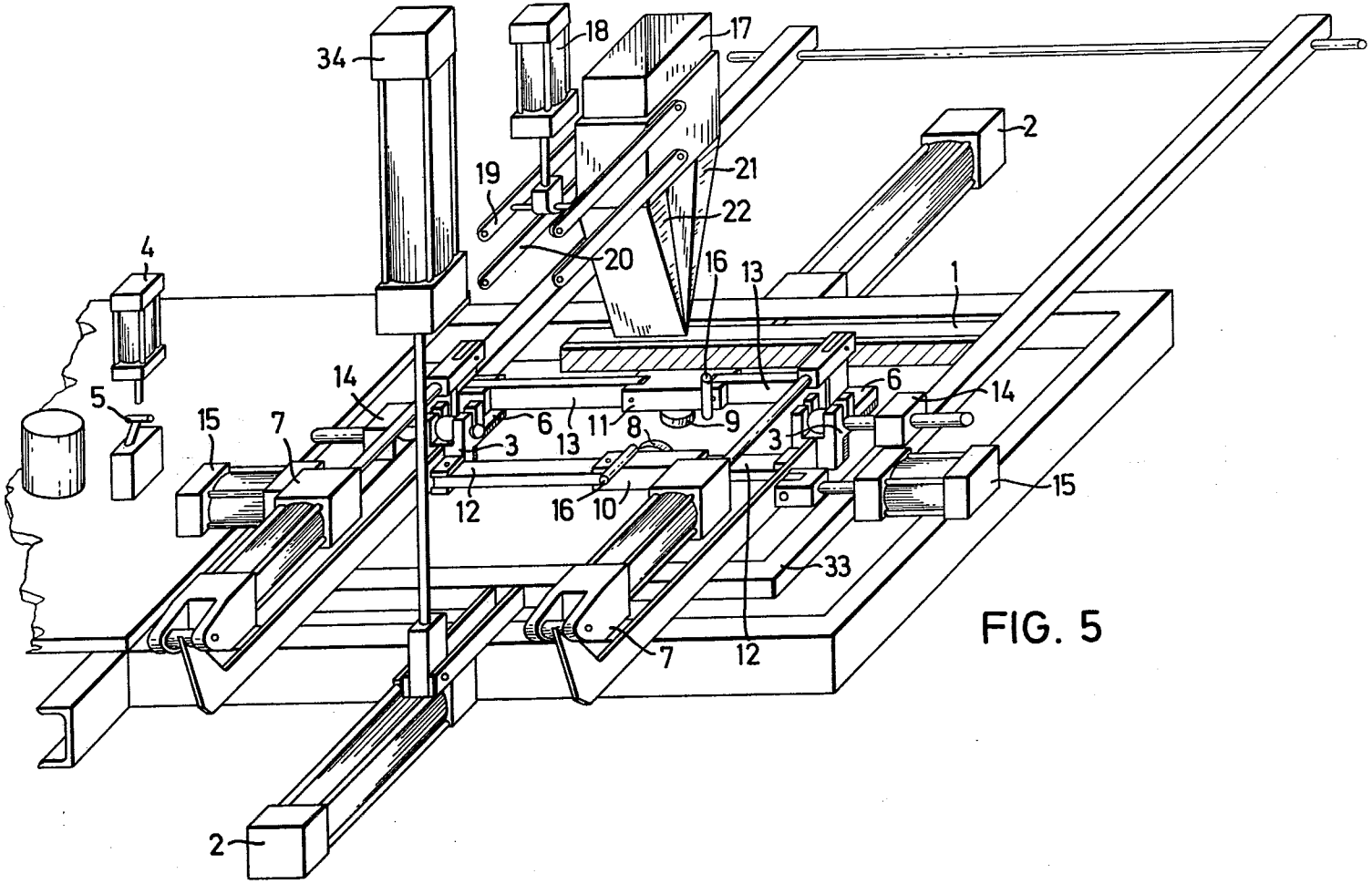
FIG. 5 is a perspective representation of the filling station (Station II)
Figure 6:
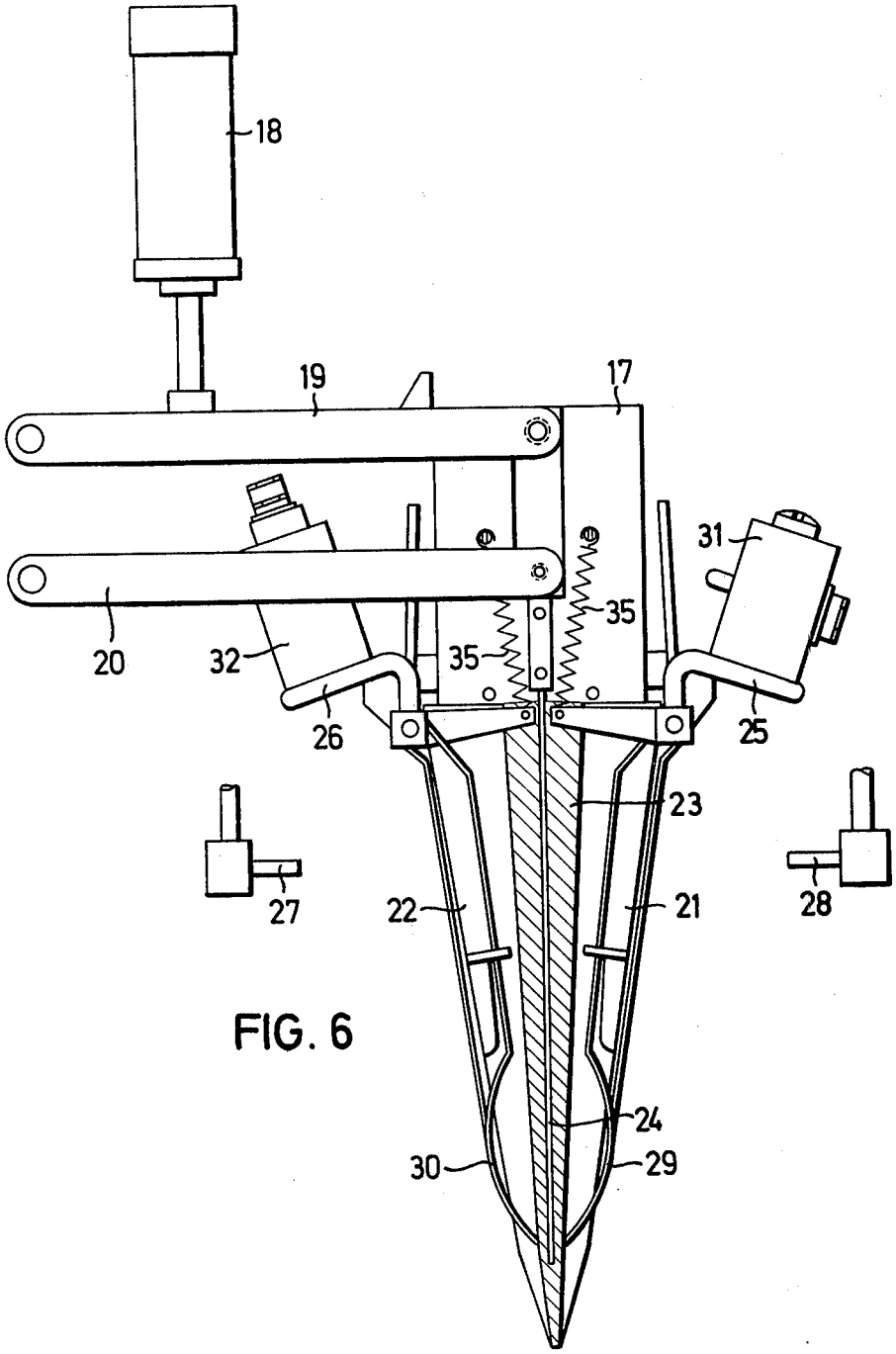
FIG. 6 is a side elevational view of the filling nozzle in the filling station.

The filling station is shown as a part of the entire machine in FIGS. 1 to 3 and more in detail in FIG. 5. Details of the filling tube are seen in FIG. 6.

The gusseted bag gripped between the transport grippers 1 is transported to the filling station. From FIG. 5 it may be seen that the transport grippers are opened and closed through compressed air cylinder 4, control valve 5 and cylinder 2. Whenever the gusseted bag is in the filling station, the compressed air cylinders 7 press the gripping jaws 6 against the stationary jaws 3, thus closing them. The suction nozzles 8 and 9 are held by mounting means 10 and 11. The stationary gripping jaws 3 are joined by connecting rods 12 to mounting means 10 and the pivoting jaws 6 are joined by connecting rods 13 to the suction nozzle mounting means 11. The gripping jaws 6, together with connecting rods 13, mounting means 11 and suction nozzle 9 are opened and closed by compressed air cylinder 7. Thus, the connecting rods 13, mounting means 11 and the suction nozzle pivot all together whenever the gripping jaws 6 are closed.

The gripping jaws 3 and 6 with compressed air cylinders 7, connecting rods 12 and 13, mounting means 10 and 11, suction nozzles 8 and 9, are mounted in common on a guide 14 and are moved toward the center by the compressed air cylinders 15 and drawn apart again after completion of a filling. To clean the suction nozzles, tubes 16 are so mounted that, when they are fed with compressed air the suction surfaces are cleaned. When the gripping jaws 6 are in the closed position the vacuum at suction nozzles 8 and 9 is released and at the same time, through cylinder 4 and control valve 5, the transport grippers 1 are opened by cylinder 2. The compressed air cylinders 15 push the gripping jaws 3 and 6 together, which fold the bag in the area of the gussets. At the same time, by means of the connecting rods 12 and 13, the mounting means 10 and 11 together with suction nozzles 8 and 9 which have vacuum-gripped the sidewalls of the bag, are spread apart, and thus the bag is opened.

The filling spout 17 is raised and lowered by cylinder 18 through lever 19 and parallel guide 20. On the lower portion of the filling spout 17 are located pivotable insertion flaps 21 and 22. These are joined together by bellows 23 of rubber or plastic. To prevent the bellows 23 from being pushed outwardly by spring 35 when the insertion flaps are swung upwardly or closed, one spring 24 is mounted on each side. The levers 25 and 26 joined to the flaps 21 and 22 engage the adjustable stops 27 and 28 when the filling spout is lowered and are thus positively opened. When the feelers 29 and 30 contact the interior wall of the bag they actuate the limit switches 31 and 32.

If the bag is open, the compressed air cylinder 18 lowers the filling spout 17 together with the pivoting insertion flaps 21 and 22 into the bag. Shortly before reaching the bottom descent point, the levers 25 and 26 engage the adjustable cams or stops 27 and 28 and open the insertion flaps. The pivoting feelers 29 and 30 verify whether a bag is present and whether the bag is open. Even if only one of the feelers 29 or 30 fails to be moved inwardly because it is not engaging the interior wall of a bag, the filling of the bag will not be started. If both feelers 29 and 30 engage the sidewall they are positively moved inwardly; in this manner, as mentioned, the limit switches 31 and 32 are actuated, which transmit a pulse to a scale or to a proportioner, which is not represented, and the filling commences. Simultaneously with this actuating pulse the open bag, held at the gussets, is lifted with the pivoting frame 33 by the actuation of the compressed air cylinder 34, because the pivoting frame bears the described devices for opening the bag. The lower portion of the empty bag, which is still folded together, rests on the floor of the bag seat 36. If the bag were not lifted, no material would enter into the curled bottom portion of the bag and the degree of fill would be unsatisfactory. By the raising action the bag is completely lifted away from the bag seat and thus a maximum fill is achieved. When the bottom of the bag is filled with material the pivoting frame is again lowered. When the filling is completed the filling spout 17 together with the insertion flaps 21 and 22 are removed from the bag by the actuation of the compressed air cylinder 18. When the filling spout has returned to its starting position, the gripping jaws 3 and 6 are again separated by the compressed air cylinder 15 and the upper portion of the filled bag is thereby made taut so that the bag walls located between the gussets come together again in this area. When the bag is taut, the transport grippers 1 are closed by cylinders 2 upon the actuation of the compressed air cylinder 4 and the valve 5. Then the compressed air cylinders 7 raise the gripping jaws 6 and the filled gusseted bag is automatically transported to the closing operation. Before a fresh bag enters into the filling station, the suction nozzles 8 and 9 are cleaned by a brief blast of compressed air, inside and outside, from the tubes 16.

The described filling apparatus can cooperate with any known apparatus for the feeding of material for bagging. It is directly apparent that it is also suitable for the filling of simple flat bags as well as gusseted bags.

Bag Closing Station III

The elements of this closing station are diagrammatically represented in FIG. 7. At the end of a turnstile standstill period, the welding jaws 48 are closed by compressed air cylinder 47 and the bag is welded at the top. When the weld is completed the welding jaws 48 are opened and the transport grippers 1 remain closed.

The filled bag, closed at the top, is now transported by the turnstile 37 to Station IV.

Bag Transfer Station IV

The filled bag remains standing for a time in Station IV so that the weld seam may cool. At the end of the cooling period the gripping jaws 1 are opened by cylinders 2. When they are open, the bag seat 36 is tilted through a compressed air cylinder and the filled bag is transferred to a succeeding transporting means.

The apparatus of the second embodiment shown in FIGS. 9 to 12 has an increased output because here the various apparatus are doubled. Here two bags are disposed in each of Stations I to IV with their flat sides adjacent each other. The four arms of the turnstile 37 have two bag seats 36 and **36*a* each, and two pairs of transport grippers 1 and 1*a*** each, which simultaneously advance two bags from Station I successively to Station IV, so that two filled and closed bags are obtained per operating cycle.

Stations I to IV of the second embodiment represented in FIGS. 9 to 12 will now be described in detail.

Bag Making Station I

Figure 9:
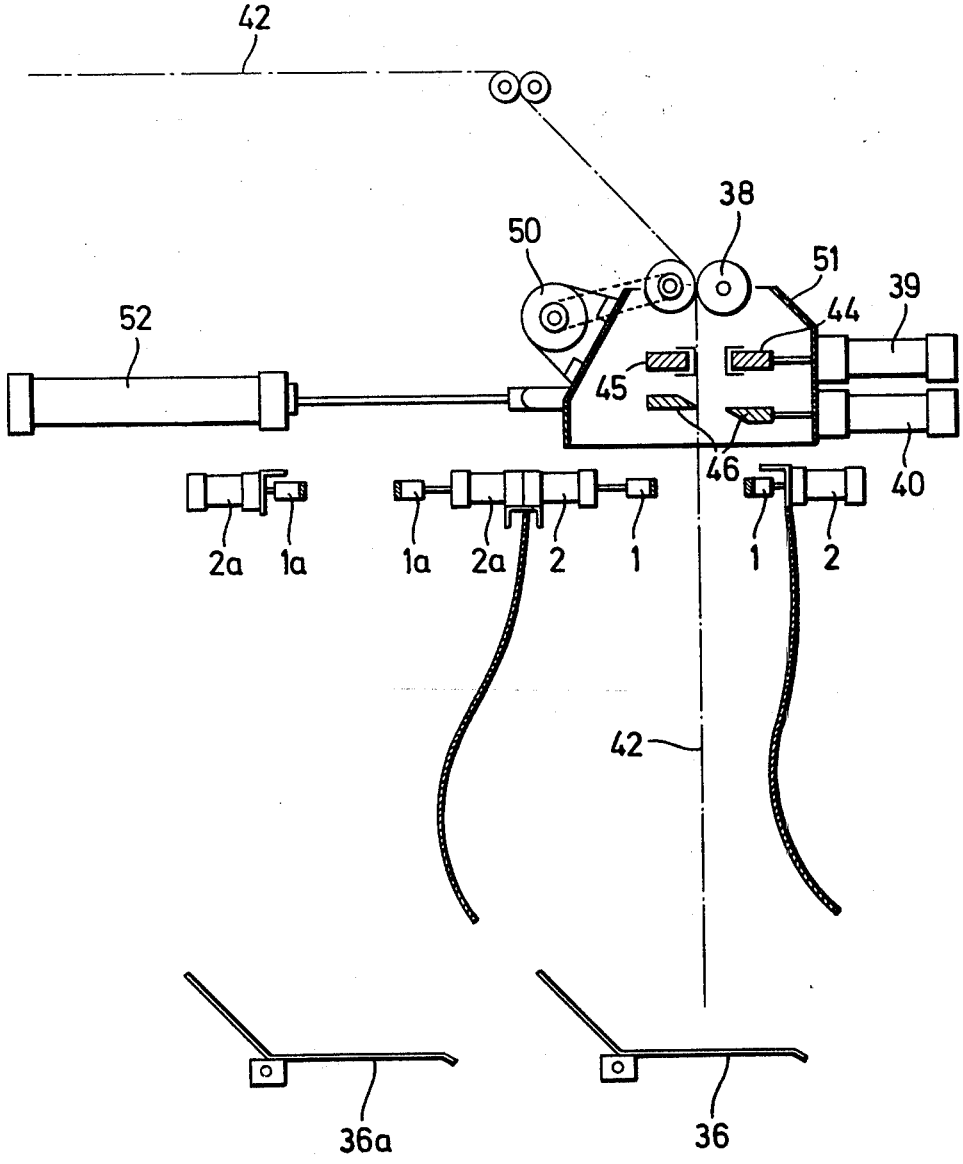
FIG. 9 shows bag making station I of a second embodiment.

In the apparatus of FIG. 9, the difference in relation to FIG. 4 is that two seats 36 and **36*a* as well as two transport gripper pairs 1 and 1*a* with corresponding compressed air cylinders 2 and 2*a* are arranged side by side. The bag-making is the same as in FIG. 4. A difference in FIG. 9 is that the braking motor 50 with the feed rolls 38 for the web of tubular film 42, the welding jaws 44 and 45 and the cut-off knives 46 are mounted on, or within as the case may be, a common frame 51 which can be moved by means of a linear actuator, e.g., compressed air cylinder 52, horizontally from one bag seat 36 to the adjacent bag seat 36*a* and back. According to FIG. 9, therefore, the oncoming gusseted tube of film 42 is fed successively, within the operating cycle, first down through the one pair of transport grippers 1 to a bag seat 36, and then down through the other transport gripper pair 1*a* to the adjacent bag seat 36*a*. Within the movable frame 51, the bottom seam of each bag is welded and the bag is severed from the web of film tubing. To lengthen the welding contact time the feed of the film through the feed rolls 38** may be accelerated.

The welded bottom seams of the bags may be force-cooled by a stream of air.

It would also be possible to feed simultaneously to the two pairs of transport grippers 1 and 1*a* two paper bags or two ready-welded gusseted bags, or two webs of film tubing simultaneously. The films of which the bags or tubes are made may also be laminated films.

Bag Filling Station II

Figure 10:
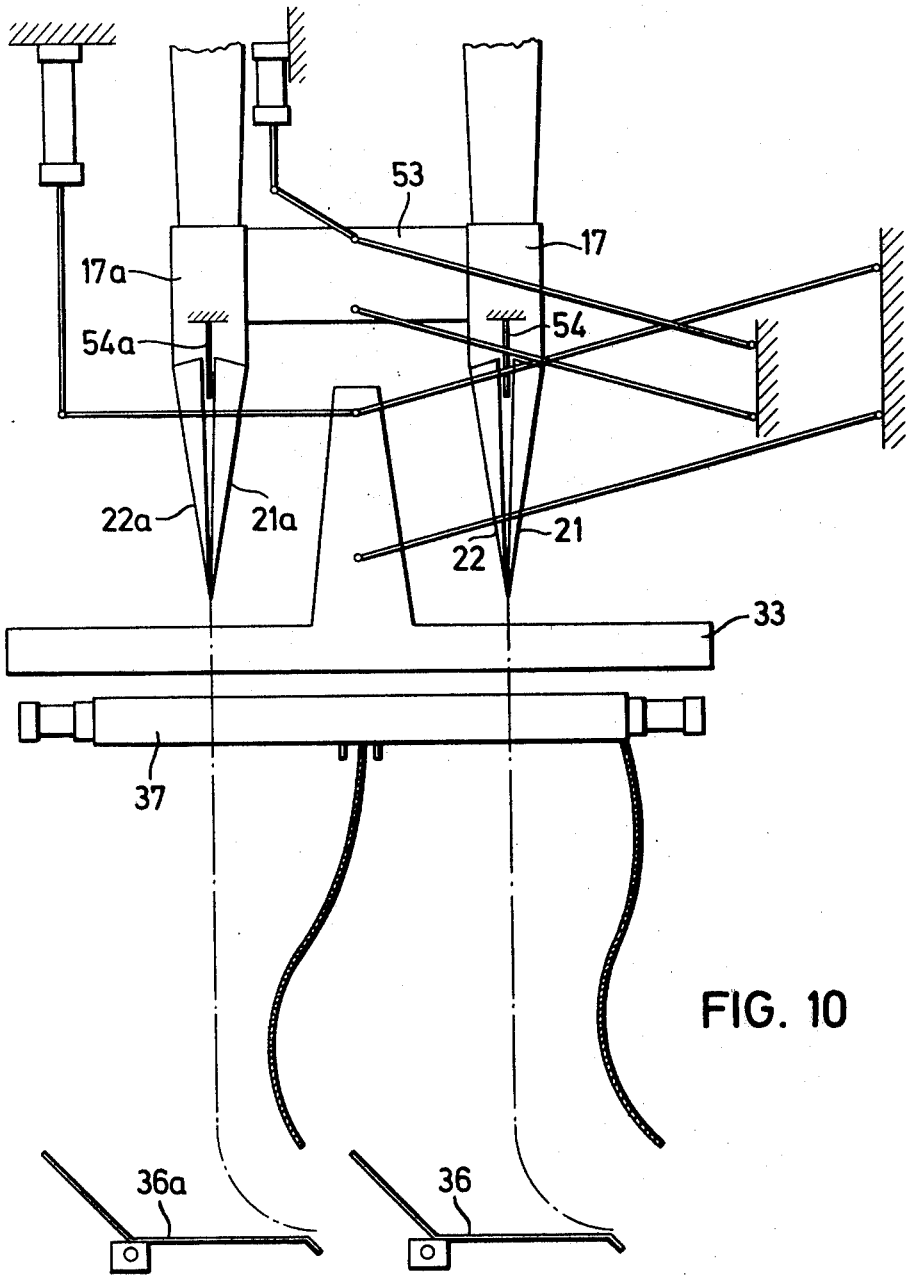
FIG. 10 shows the bag filling station II of the second embodiment.

The operations performed in the bag filling operation according to FIG. 10 is no different from those in FIGS. 5 and 6. In FIG. 10, however, the difference from FIG. 5 is that the bag opening mechanism consisting of gripping jaws 3 and 6, suction nozzles 8 and 9, connecting rods 12 and 13 and mounting means 10 and 11, as well as the filling spouts 17 and 17*a* with their respective pivoting insertion flaps 21–22 and 21*a*–22*a* are disposed two by two adjacent one another. The two adjacent bag opening mechanisms are located in a common raising and lowering frame 33 and the two filling spouts 17 and 17*a* are located in a common raising and lowering frame 53. The two frames 33 and 53 are guided parallelly by link rods, i.e., the two bag opening mechanisms and filling spouts are coupled for movement together with one another. It would also be possible to control each filling spout and bag opening mechanism separately, but this would increase the amount of mechanical, pneumatic and electrical means required.

To make the opening of the sidewalls of the bag still more reliable, air nozzles 54 and 54*a* are mounted laterally alongside the filling spouts 17 and 17*a*, respectively, by means of which an air jet is blown between the free sidewalls of the bag before the suction nozzles 8 and 9 of the bag opening mechanism are drawn apart.

Bag Closing Station III

Figure 11:
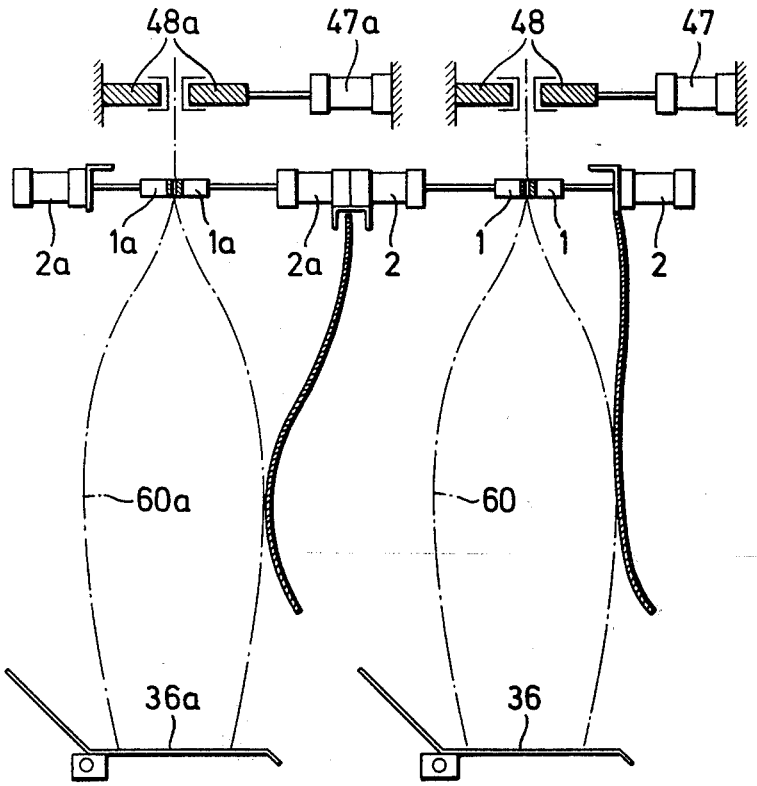
FIG. 11 shows the bag closing station III of the second embodiment.
Figure 13:
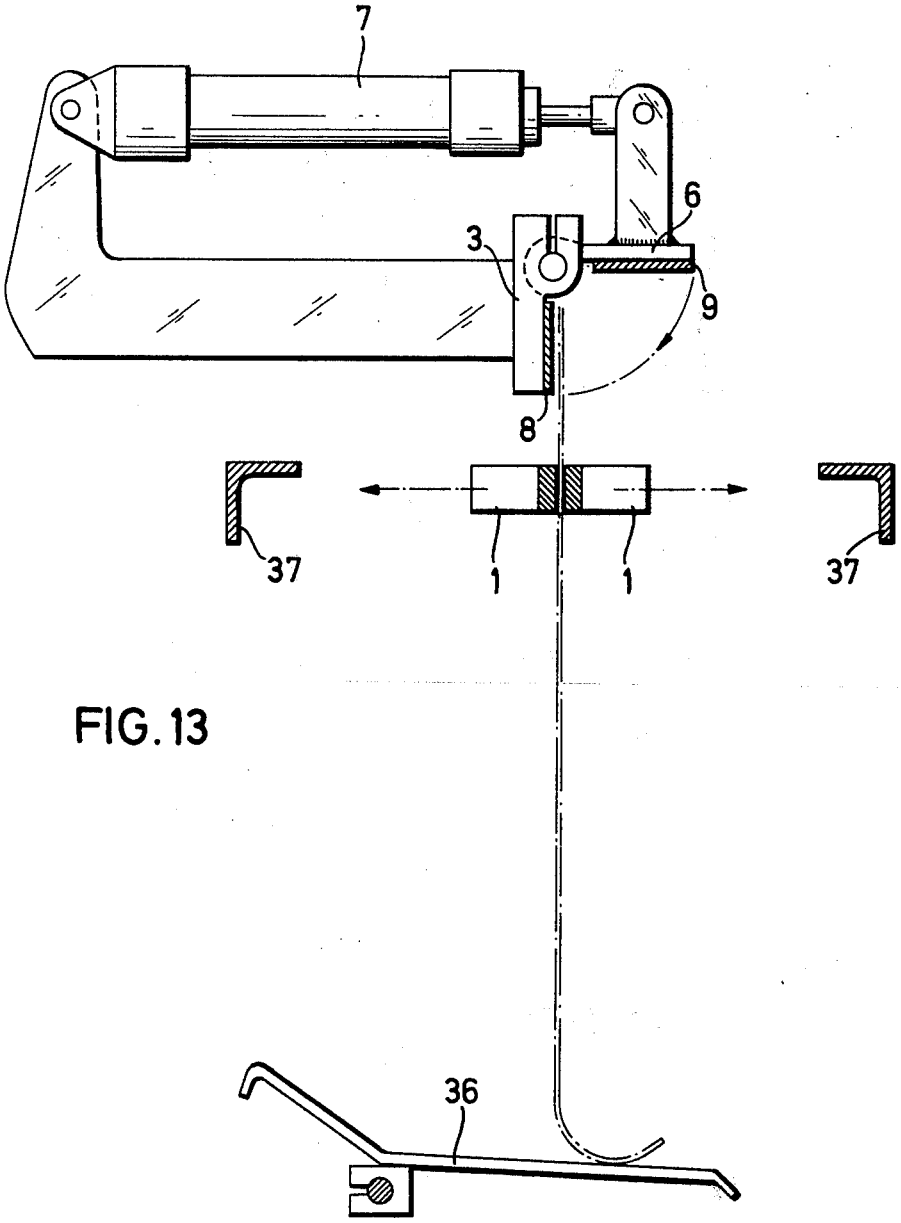
FIG. 13 is an elevation view of a part of the filling station with an empty bag positioned there.
Figure 14:
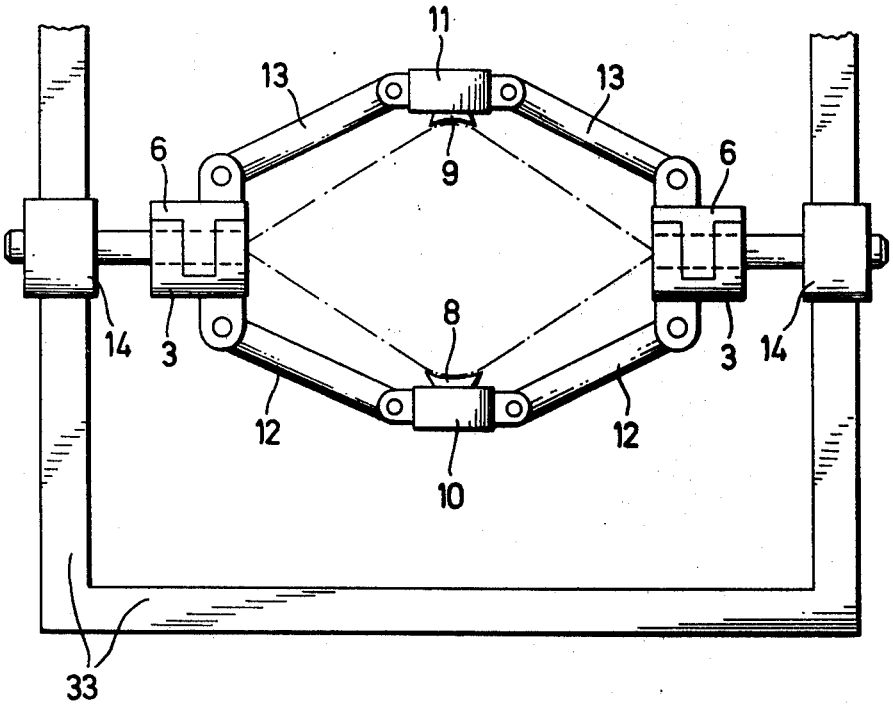
FIG. 14 is plan view of a part of the filling station illustrating the bag opening mechanism and showing the bag in the open condition.
Figure 15:
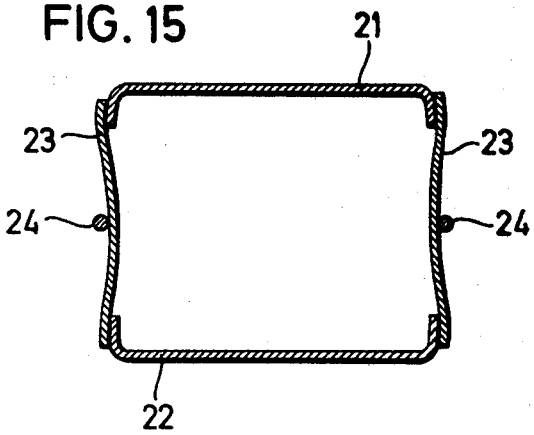
FIG. 15 is plan, cross section view through the lower third of the filling nozzle shown in FIG. 6.

In FIG. 11 two welding jaw pairs 48 and 48*a* are arranged beside one another, in contrast to FIG. 7. Here the two filled bags 60 and 60*a* are simultaneously sealed by a top weld. Otherwise, the preformance of the operations is no different from FIG. 7.

Bag Transfer Station IV

In this last station, in accordance with FIG. 12, an apparatus 54 and 54*a*, respectively, is provided for forced cooling, especially air cooling of the top weld seams. The two filled and closed bags 60 and 60*a* remain standing in Station IV until the top weld seams have been cooled by the action of the forced cooling system. At the end of the cooling period the bags are successively transferred to the succeeding conveyor belt 56 to be carried away.

The bag seats 36 and 36*a* are obtusely angled in cross section and in Station IV they are tipped about a pivot 55, 55*a*, such that the filled and closed bags are dropped onto the conveyor belt 56 with the bottom seam foremost. Strain on the top weld is thus avoided. In FIG. 12, the left pair of transport grippers 1*a* has just opened and the bag seat 36*a* has been tilted downward on pivot 55*a*. The bag 60*a* thus falls in an approximately upright position down the bag seat 36, landing on its bottom seam on the conveyor belt 56. Then the second bag 60 is transferred in the same manner to conveyor belt 56.

It is stated, that the hereinforce described stations III and IV may be combined to a single station.

We claim:

1. An apparatus suitable for production and filling of bags comprising:

a. a fixed frame having serially mounted thereon a number of working stations including a bag making station having means for producing bags, and a bag filling station having means for filling the bags, b. transporting means for transporting the bags serially from station to station including from the bag making station to the bag filling station, the improvement which comprises:

c. the bag making means comprising means for providing a length of the bag material longer than the length of the bag in flat, depending condition, and a cutter for cutting the material to the bag length, d. the transporting means comprising transport grippers for holding the bag during the cutting below and adjacent the cutter so as to leave an upper, open end portion of the bag standing upright in flat condition above the transport grippers after the cutting, and for holding the bag during movement thereof to the filling station in said condition and holding the bag at the filling station in said condition, and means for selectively engaging and disengaging the transport grippers with the bag, e. the means for filling the bag comprising bag holding means and opening means, the holding means comprising gripping jaws for gripping from outside the bag the upper corner portions of the bag disposed within said upright end portion of the bag disposed above the transport grippers, the opening means comprising grasping means for grasping the sides of the bag at the top between the gripping jaws and pulling the sides of the bag apart to open the bag for filling, f. said selective engaging and disengaging means for the transport grippers permitting disengagement of the transport grippers after gripping of the bag by the gripper jaws and before opening of the bag by the opening means, g. the filling station further comprising a bag filling means for introducing material into the open bag.

2. Apparatus according to claim 1, the bag holding means and opening means (e) being assembled together so that with the gripping jaws of the holding means gripping the upper corners of the bag, and the grasping means of the opening means grasping the sides of the bag, movement of the gripping jaws toward each other causes the grasping means to spread apart for the opening of the bag, and the bag filling station comprising means for moving the gripping jaws toward each other.

3. Apparatus according to claim 2, and guiding means mounted at the filling station for guiding assembly of holding means and opening means during the movement of the gripping jaws toward each other.

4. Apparatus of claim 1, wherein the two stations are distributed about a circle and that the transporting means comprises a turnstile having two arms and being rotatably disposed beneath the two stations, each of the two arms thereof being provided with a number of bag seats and the same number of said transport grippers for the disposition of a plurality of bags at each station.

5. Apparatus according to claim 4, said working stations comprising a bag closing station outfitted with means for closing the bags and following the bag filling station, and a bag transfer station following the bag closing station outfitted with means for transferring the filled, closed bags from the apparatus, the transfer means comprising means for tipping of the bag seats to dump the bags from the seats, the seats being obliquely angled so that the bags fall off the seats upon tipping thereof, with the bottom of the bag foremost.

6. Apparatus of claim 4, wherein in each of the working stations is constructed to handle two bags with their flat sides adjacent one another, and wherein each of the two arms of the turnstile has two of said transport grippers and two bag seats.

7. Apparatus according to claim 6, the bag making station comprising a common frame reciprocatable between a first position overlying one of the bag seats and a second position overlying the other of the bag seats, the cutter and said means for providing a length of bag material (c) being mounted on the on the common frame, for successively making a bag over one of said bag seats and then over the other.

8. Apparatus according to claim 6, said working stations comprising a bag closing station following the bag filling station, and duplicate means for closing bags mounted at the bag closing station.

9. Apparatus according to claim 6, wherein the bag filling station comprises the bag holding means and bag opening means (e) and filling means (g) in duplicate, coupled for movement and operating together with one another for filling two bags held in the two seats of the turnstile at the filling station.

10. Apparatus according to claim 9, the duplicate bag opening means and bag holding means (e) being mounted in a moveable frame for raising and lowering thereof to assure full distention of the bags for the filling thereof, and the duplicate filling means being mounted in a movable frame for raising and lowering thereof for filling of the bags.

11. Apparatus according to claim 1, the transport means comprising a bag seat for holding the bottom of the bag, the bag filling station comprising means for raising the bag holding and opening means (e) for distending of the bag to assure filling of the bottom portion thereof at the filling station.

12. Apparatus according to claim 11, the means for raising the bag holding and opening means (e) comprising frame pivotally mounted at the filling station, the bag holding and opening means being mounted on the frame for moving therewith.

13. Apparatus according to claim 11, the filling means (g) of the filling station comprising a closable filling spout for insertion into the open top of the bag, means for lowering and raising the filling spout into and out of the open top, a stop mounted in a fixed poistion at the filling station, the filling spout having a lever for engagement with the stop upon the lowering of the spout and opening of the spout upon such engagement.

14. Apparatus according to claim 13, feelers mounted on the filling spout for sensing whether the bag is open when the filling spout is lowered, control means for controlling the filling of the bag, and means operatively interconnecting the feelers and control means for actuation of the control means only if the feelers sense that the bag is open when the spout is lowered.

15. Apparatus according to claim 13, the filling spout comprising flaps for opening and closing for opening and closing of the filling spout, the flaps being pivotally mounted at their upper ends, and bellows joining together the flaps so that upon opening of the flaps, the flaps and bellows form the spout for passage of the filling material to the bag, and a spring wire mounted alongside each bellows and on the filling spout for preventing the bellows from folding outwardly when the spout is closed.

16. Apparatus according to claim 1, and means mounted at a working station for directing an air jet between the side walls of the bag.

17. Apparatus according to claim 1, said working stations comprising a bag closing station following the bag filling station and a bag transfer station outfitted with means for transferring the filled, closed bags from the apparatus, means for closing the bags by welding mounted at the bag closing station, and means for cooling the closing welds at the transfer station.

18. Apparatus according to claim 1, the bag filling station comprising means for closing the transport grippers after each bag has been filled.

* * * * *